US007374309B2

(12) United States Patent
Cutler-Bass

(10) Patent No.: US 7,374,309 B2
(45) Date of Patent: May 20, 2008

(54) WATERPROOF, MINIATURE LIGHT-EMITTING DIODE (LED) DEVICE

(75) Inventor: Judy Cutler-Bass, Somerset, NJ (US)

(73) Assignee: Horizon Group - USA, Inc., Warren, NJ (US)

( * ) Notice: Subject to any disclaimer, the term of this patent is extended or adjusted under 35 U.S.C. 154(b) by 101 days.

(21) Appl. No.: 11/397,258

(22) Filed: Apr. 4, 2006

(65) Prior Publication Data

US 2007/0230168 A1 Oct. 4, 2007

(51) Int. Cl.
*F21L 4/00* (2006.01)

(52) U.S. Cl. ..... 362/203; 362/800; 362/285; 42/146; 401/257; 401/258

(58) Field of Classification Search ..... None
See application file for complete search history.

(56) References Cited

U.S. PATENT DOCUMENTS

| | | | | |
|---|---|---|---|---|
| 4,733,337 | A * | 3/1988 | Bieberstein | 362/206 |
| 4,774,643 | A * | 9/1988 | McGinnis et al. | 362/189 |
| 5,043,856 | A * | 8/1991 | Levin | 362/309 |
| 5,174,649 | A | 12/1992 | Alston | |
| 5,893,633 | A | 4/1999 | Uchio et al. | |
| D446,325 | S | 8/2001 | Guerrieri | |
| D447,584 | S | 9/2001 | Guerrieri | |
| 6,318,879 | B1 * | 11/2001 | Huang | 362/205 |
| 6,398,383 | B1 * | 6/2002 | Huang | 362/202 |
| D482,469 | S | 11/2003 | Guerrieri | |
| 6,761,468 | B1 | 7/2004 | Bogal | |
| 6,776,502 | B2 | 8/2004 | Hung | |
| 6,777,890 | B1 | 8/2004 | Huang | |
| 6,840,654 | B2 | 1/2005 | Guerrieri et al. | |
| 6,848,808 | B2 | 2/2005 | Guerrieri | |
| 6,857,771 | B2 | 2/2005 | Guerrieri | |
| 6,900,735 | B2 | 5/2005 | Guerrieri et al. | |
| 6,908,219 | B1 * | 6/2005 | Reiss | 362/338 |
| 2003/0090895 | A1 | 5/2003 | Guerrieri | |

(Continued)

OTHER PUBLICATIONS

Printout of Internet advertisement for "Blinking Balloons.com" dated Jun. 24, 2005; website: http://www.blinkingbaloons.com/balloonlightfaq.html.

*Primary Examiner*—Sandra O'Shea
*Assistant Examiner*—Danielle Dunn
(74) *Attorney, Agent, or Firm*—Robert P. Michal; Frishauf, Holtz, Goodman & Chick, P.C.

(57) ABSTRACT

Waterproof miniature LED device including a cylinder having a first housing part with an internal thread and a second housing part with an external thread and rotatably coupled to the first housing part via engagement of the threads, an LED light assembly mounted to the cylinder and a dome connected to the cylinder and covering the LED light assembly. The cylinder defines a chamber for receiving batteries. Each housing part is conductive to enable formation of an electrical circuit including the batteries, LED light assembly and conductive portions of the housing parts. Illumination provided by the LED light assembly is controlled by rotating the housing parts relative to one another causing formation or interruption of the electrical circuit. An elastic ring covers a space between the housing parts alongside the threads to prevent water from entering between the threads into the interior of the cylinder and interrupting the electrical circuit.

21 Claims, 1 Drawing Sheet

U.S. PATENT DOCUMENTS

2003/0179573 A1 9/2003 Chun
2004/0017684 A1 1/2004 Huang
2004/0090777 A1* 5/2004 Lee ..... 362/202
2004/0165378 A1* 8/2004 Galli ..... 362/202
2005/0018421 A1 1/2005 Parsons

* cited by examiner

WATERPROOF, MINIATURE LIGHT-EMITTING DIODE (LED) DEVICE

FIELD OF THE INVENTION

The present invention relates generally to a miniature light-emitting diode (LED) device and more specifically to a miniature LED-light emitting device which is waterproof and therefore can be used in environments in which it will be exposed to water.

BACKGROUND OF THE INVENTION

A typical miniature LED device includes a metal cylinder in which an LED and batteries for providing power thereto are received. The cylinder includes opposite axial parts whereby one axial part has a tubular part with an internal thread while the other axial part has a smaller diameter tubular part with an external thread engageable with the internal thread, with the cooperating threads allowing relative rotation between the axial parts. Illumination of the LED is controlled by rotating one axial part of the metal cylinder relative to the other axial part which regulates the formation or interruption of a circuit between the LED and the batteries.

To enable the relative rotation of one axial part of the metal cylinder relative to the other, a space must be maintained between opposed edges of the axial parts. This space is defined between edges of the axial parts which are substantially perpendicular to and alongside the threads. As the axial parts are rotated relative to one another, the dimensions of this space vary.

A particular problem with such miniature LED devices is that when the LED devices are exposed to water, the water can enter into the space between the opposed edges of the axial parts. From this space, the water can seep between the threads into the interior of the LED device and interrupt the circuit between the LED and the batteries, i.e., cause a short-circuit. Once this happens, the LED device is rendered useless. In view of this problem, such miniature LED devices are often not used in environments in which water is likely to be present.

Another problem with such miniature LED devices is that one of the axial parts might be inadvertently rotated relative to the other thereby turning the LED on or off when set in either position, i.e., the inadvertent rotation might turn the LED off when the device is set in the on position or turn the LED on when the device is set in the off position.

It would therefore be desirable to have an LED device which is waterproof and can be used in all environments including those in which it will be exposed to water, and also an LED device which can be maintained in its set position without allowing inadvertent rotation of the axial parts relative to one another.

OBJECTS AND SUMMARY OF THE INVENTION

It is therefore an object of the present invention to provide a new and improved miniature LED device which is waterproof.

It is another object of the present invention to provide a new and improved miniature LED device which allows for two axial parts to be rotatable relative to one another to enable control of illumination of the LED via such rotation while preventing entry of water into a space between the axial parts necessary to allow such rotation.

It is yet another object of the present invention to provide a new and improved miniature LED device which can be maintained in its set position without allowing inadvertent rotation of the axial parts relative to one another to cause the set position to change.

In order to achieve these objects and others, a miniature light-emitting diode (LED) device in accordance with the invention includes a cylinder including a first housing part having an internal thread and a second housing part having an external thread and rotatably coupled to the first housing part via engagement of the threads, an LED light assembly arranged in connection with the cylinder and a dome connected to the cylinder in a position covering the LED light assembly. The cylinder defines a chamber in which one or more batteries are received. At least a portion of each housing part is conductive to enable formation of an electrical circuit including the battery or batteries, the LED light assembly and the conductive portions of the housing parts. Illumination provided by the LED light assembly is controlled by rotating the housing parts relative to one another causing formation or interruption of the electrical circuit.

The device also includes an elastic ring or similar structure which covers a space between the housing parts and alongside the threads to prevent water from entering between the threads into the interior of the cylinder and interrupting the electrical circuit. The device is thereby rendered waterproof and can be used in environments where water is present.

Furthermore, in view of a friction fit of the elastic ring to both housing parts, it prevents inadvertent movement of the housing parts relative to one another to thereby prevent inadvertent changing of the on or off status of the device. The device's status can therefore be reliably maintained.

In one embodiment, the dome is faceted to provide better light distribution and a distinctive illumination when the LED light assembly is operative. A faceted dome can be used independent of the elastic ring or other structure which prevents water from entering between the threads, i.e., the invention contemplates an embodiment wherein the device includes a faceted dome but does not include the elastic ring.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein.

DETAILED DESCRIPTION OF THE INVENTION

Figure 1:
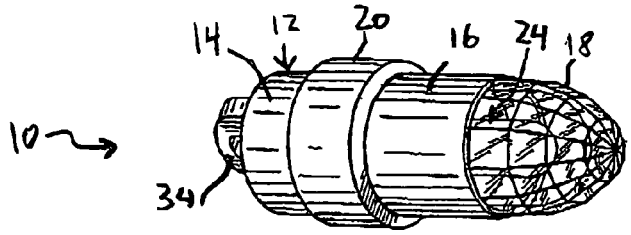
FIG. 1 is a perspective view showing a miniature LED device in accordance with the invention.
Figure 2:
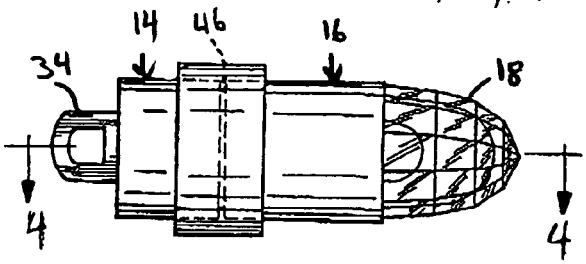
FIG. 2 is a front elevational view of the miniature LED device in accordance with the invention.
Figure 3:
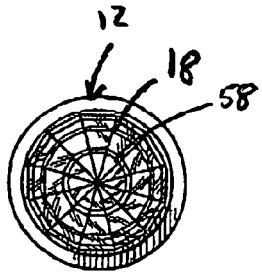
FIG. 3 is an end view of a faceted dome of the miniature LED device in accordance with the invention.

Referring to the accompanying drawings wherein like reference numerals refer to the same or similar elements, a miniature LED device 10 in accordance with the invention includes a cylinder 12 having a bottom housing part 14 and a top housing 16, a faceted dome 18 coupled to the top housing part 16, an elastic ring 20 arranged around the cylinder 12, batteries 22 housed in a chamber defined in the cylinder 12 and an LED light assembly 24 arranged in connection with the cylinder 12. In the convention used herein, the bottom of the device 10 is considered the leftmost part of the device 10 as shown in the drawings whereas the top of the device 10 is considered the rightmost part of the device 10 as shown in the drawings.

Both bottom and top housing parts 14, 16 are made at least partially of an electrically conductive material such as metal to enable completion of an electric circuit including the batteries 22 and the LED light assembly 24. Additional details of the formation of this circuit are described below.

Bottom housing part 14 includes a circular base 26, a tubular part 28 extending upward from the periphery of the base 26, an internal thread 30 formed on an inner surface of the tubular part 28, a contact button 32 arranged on the base 26 inside of the tubular part 28 and a through ring 34 extending downward from the base 26. Through ring 34 enables the device 10 to connect to holding means such as a hook, string or wire for hanging the device 10.

Top housing part 16 includes a first tubular part 36, a second, smaller diameter tubular part 38 extending downward from the first tubular part 36, an external thread 40 formed on the second tubular part 38 and a cylindrical recess 42 at an upper region. The faceted dome 18 is secured to the first tubular part 36 and extends partially into the cylindrical recess 42. Top housing part 16 also includes an inner flange 44.

Figure 4:
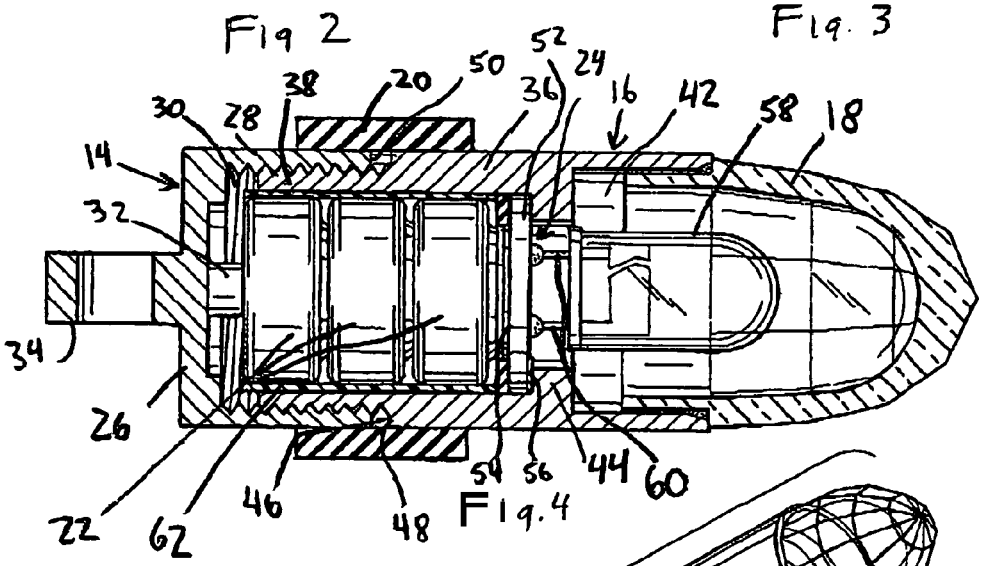
FIG. 4 is a cross-sectional side view taken along the line 4-4 of FIG. 2.

As shown in FIG. 4, there is an annular space 46 between a bottom-facing surface 48 of the top housing part 16 at the edge of the first tubular part 36 and a top-facing surface 50 of the tubular part 28 of the bottom housing part 14. Space 46 is alongside the threads 30, 40 and its size varies upon rotation of the bottom and top housing parts 14, 16 relative to one another. The bottom-facing surface 48 is part of an annular step between the first and second tubular parts 36, 38 which is formed in view of the different diameters of the first and second tubular parts 36, 38. The presence of this space 46 enables relative rotation of the bottom and top housing parts 14, 16 to control power supply to the LED light assembly 24, explained in detail below.

To prevent water from entering into the interior of the LED device 10 through space 46 and between the cooperating threads 30, 40, elastic ring 20 is slid onto the cylinder 12 to a position in which it covers or surrounds the space 46 and extends a small distance below the space 46 and a small distance above the space 46 (see FIG. 4). Elastic ring 20 has a substantially tubular form and maybe made of rubber.

The diameter of the elastic ring 20 is selected to provide a friction fit against the outer surfaces of the bottom and top housing parts 14, 16 and thereby form a water-tight seal which prevents water from entering into the space 46. However, the diameter of the elastic ring 20 is also dimensioned so that it is not overly tight against the bottom and top housing parts 14, 16 because it is necessary to maintain the ability to rotate the bottom and top housing parts 14, 16 relative to one another. Nevertheless, if the elastic ring 20 is designed to provide a very tight seal which hinders rotation of the bottom and top housing parts 14, 16 relative to one another, the elastic ring 20 could be slid up or down to a position entirely on one of the housing parts 14, 16 so that the housing parts 14, 16 can then be rotated relative to one another.

Another advantage obtained by the presence of elastic ring 20 in contact with both bottom and top housing parts 14, 16 is that inadvertent rotation of the housing parts 14, 16 relative to one another is prevented in view of the friction fit between the elastic ring 20 and the bottom and top housings parts 14, 16. As such, the LED device 10 can be reliably maintained in an on or off position without concern that inadvertent rotation will change this status.

To ensure a water-tight environment in the cylinder 12, the tubular part 28 of the bottom housing part 14 and the first tubular part 36 of the top housing part 16 do not include any uncovered openings on their outer surfaces. For example, there is no uncovered opening in either tubular part for an activation strip which is often provided in prior art miniature LED devices to separate the batteries from an electrical contact in order to prolong battery life by initiating operation only after the activation strip is removed. The presence of an uncovered opening for an activation strip would allow water to enter into the interior of the cylinder. If it is desired to provide such an activation strip in the LED device in accordance with the invention and an opening therefor is required, the opening for the activation strip can be formed in close proximity to the space 46 between the bottom and top housings parts 14, 16 so that the opening is covered by the elastic ring 20.

Additional protection against water seeping into the interior of the cylinder 12 is provided by securing the faceted dome 18 to the first tubular part 36 of the top housing part 16 in a water-tight matter. As such, water cannot seep into the interior of the cylinder 12 between the top housing part 16 and the faceted dome 18.

LED light assembly 24 includes a substantially planar printed circuit board 52 having a first electrical contact 54 on a lower surface which engages with the positive terminal of the uppermost one of the batteries 22 and a second electrical contact 56 on an upper surface which engages with the flange 44 of the top housing part 16. A light-emitting diode (LED) 58 is mounted to the upper surface of the printed circuit board 52 via a pair of electrical contacts 60 (see FIG. 5). When arranged in the top housing part 16, the printed circuit board 52 of the LED light assembly 24 is below the flange 44, the LED 58 is above the flange 44 and the contacts 60 extend through an opening defined by the flange 44 (see FIG. 4).

When the bottom and top housing parts 14, 16 are engaged with one another via the cooperating threads 30, 40, they can be rotated in one direction relative to one another to cause the contact button 32 to contact the negative terminal of the lowermost one of the batteries 22 and urge the positive terminal of the uppermost one of the batteries 22 against the first electrical contact 54. At the same time, the second electrical contact 56 is urged against the flange 44. In this state, shown in FIG. 4, an electrical circuit is completed from the negative terminal of the lowermost one of the batteries 22, through the contact button 32 on the bottom housing part 14, through the bottom and top housing parts 14, 16 to the second electrical contact 56 of the printed circuit board 52, through wiring on the printed circuit board 52 and one electrical contact 60 to the LED 58, through the other electrical contact 60 connected to the LED 58 to the printed circuit board 52 and through wiring on the printed circuit board 52 to the first electrical contact 54 in contact with the positive terminal of the uppermost one of the batteries 22. As such, rotation of the bottom and top housing parts 14, 16 relative to one another controls illumination of the LED 58 in that it selectively brings the contact button 32 into or out of contact with the negative terminal of the lowermost one of the batteries 22 to form or interrupt the electrical circuit between the batteries 22 and the LED light assembly 24.

Bottom and top housings parts 14, 16 may be made entirely of a conductive material or only partly of conductive material. It will suffice that only a portion of the bottom and top housing parts 14, 16 which establishes a conductive path from the contact button 32 to the surface of the top housing part 16 being contacted by the second electrical contact 56 is made of conductive material.

LED device 10 also includes a sleeve 62, preferably made of plastic or another non-conductive material, which surrounds the batteries 22, i.e., the sleeve 62 is positioned substantially between the circumferential edges of the batteries 22 and an inner cylindrical surface of the top housing part 16. Sleeve 62 electrically isolates the batteries from the top housing part 16.

Figure 5:
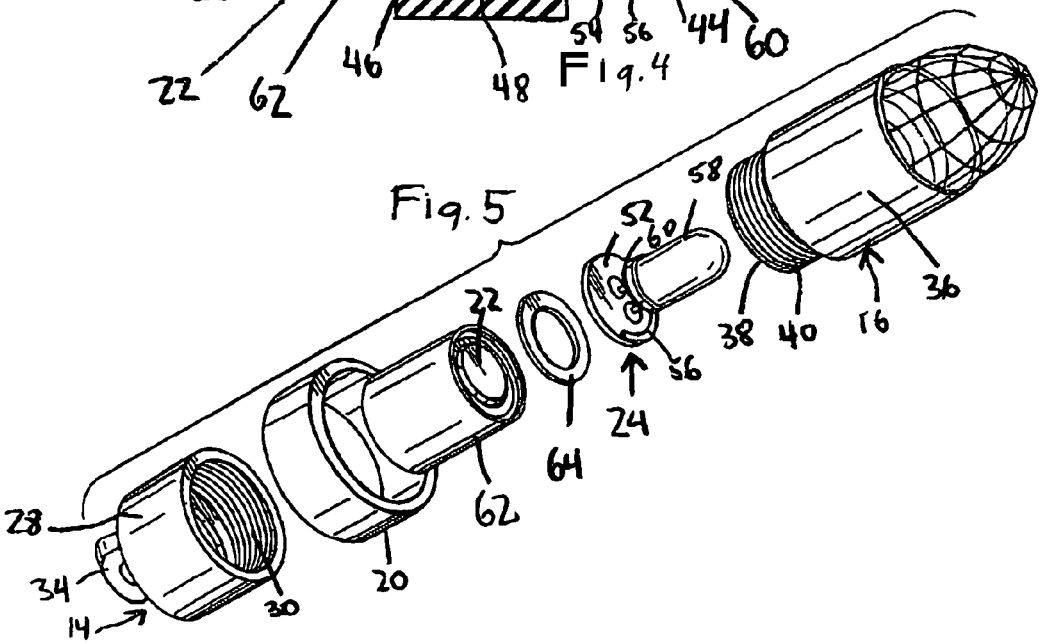
FIG. 5 is an exploded perspective view of the miniature LED device in accordance with the invention.

LED device 10 also includes a resilient washer 64 made of, for example, rubber which surrounds the positive terminal of the uppermost one of the batteries 22 (see FIG. 5).

The faceted dome 18 has a plurality of flat surfaces 66 so that light emitted from the LED 58 is better distributed and also includes with a distinctive illumination pattern.

Instead of the elastic ring 20, it is possible to use an O-ring which is placed into the space 46 between the bottom-facing surface 48 of the top housing part 16 and the top-facing surface 50 of the tubular part 28 of the bottom housing part 14. Such an O-ring would prevent water from entering into the interior of the device 10 between the threads 30, 40.

As another alternative to the elastic ring 20, any member which is arranged to cover the space 46 and/or in the space 46 and prevents water from entering between the threads 30, 40 can be used in the invention.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention. For example, although the illustrated embodiment includes three batteries, it is possible to use any number of batteries including only a single battery.

The invention claimed is:

1. A miniature light-emitting diode (LED) device, comprising:

a cylinder including a first housing part having an internal thread and a second housing part having an external thread and rotatably coupled to said first housing part via engagement of said threads, said cylinder defining a chamber for receiving at least one battery, and said first and second housing parts alongside said threads defining a space;

an LED light assembly arranged in connection with said cylinder, at least a portion of each of said first and second housing parts being made of conductive material to enable formation of an electrical circuit including said at least one battery when present in said chamber, said LED light assembly and said conductive portions of said first and second housing parts, rotation of said first and second housing parts relative to one another causing formation or interruption of the electrical circuit and thus controlling illumination provided by said LED light assembly;

a dome connected to said cylinder in a position covering said LED light assembly; and means for preventing water from entering between said threads, said means being arranged outward of said first and second housing parts, and surrounding a portion of an outer surface of each of said first and second housing parts, and being arranged to cover said space and thereby prevent water from entering into said space and then between said threads.

2. The device of claim 1, wherein said means comprise an elastic ring arranged around said space and in contact with part of both said first and second housing parts.

3. The device of claim 2, wherein said elastic ring is dimensioned to provide a friction fit against outer surfaces of said first and second housing parts.

4. The device of claim 1, wherein said means are further arranged to prevent inadvertent movement of said first and second housing parts relative to one another to thereby prevent inadvertent changing of the on or off status of the device.

5. The device of claim 1, wherein said dome is faceted.

6. The device of claim 1, wherein said first housing part includes a base, a tubular part extending upward from said base, a contact button arranged on said base inside of said tubular part, said internal thread being formed on an inner surface of said tubular part, said second housing part includes a first tubular part and a second, smaller diameter tubular part extending from said first tubular part, said external thread being formed on said second tubular part, said space being defined between a bottom-facing surface of said second housing part at an edge of said first tubular part and a top-facing surface of said tubular part of said first housing part.

7. The device of claim 1, further comprising a plurality of batteries arranged in said chamber and a non-conductive sleeve arranged around said batteries to electrically isolate said batteries from said cylinder.

8. The device of claim 1, wherein said means for preventing water from entering enables said first and second housing parts to be rotatable with respect to one another.

9. A miniature light-emitting diode (LED) device, comprising:

a cylinder including a first housing part having an internal thread and a second housing part having an external thread and rotatably coupled to said first housing part via engagement of said threads, a space being defined between said first and second housing parts alongside said threads, said cylinder defining a chamber for receiving at least one battery;

an LED light assembly arranged in connection with said cylinder, at least a portion of each of said first and second housing parts being made of conductive material to enable formation of an electrical circuit including said at least one battery when present in said chamber, said LED light assembly and said conductive portions of said first and second housing parts, rotation of said first and second housing parts relative to one another causing formation or interruption of the electrical circuit and thus controlling illumination provided by said LED light assembly;

a dome connected to said cylinder in a position covering said LED light assembly; and an elastic ring arranged outward of said first and second housing parts, and surrounding a portion of an outer surface of each of said first and second housing parts to cover said space and thereby prevent water from entering into said space and then between said threads.

10. The device of claim 9, wherein said elastic ring is arranged in contact with part of both said first and second housing parts.

11. The device of claim 9, wherein said elastic ring is dimensioned to provide a friction fit against outer surfaces of said first and second housing parts.

12. The device of claim 9, wherein said elastic ring is arranged to prevent inadvertent movement of said first and second housing parts relative to one another to thereby prevent inadvertent changing of the on or off status of the device.

13. The device of claim 9, wherein said dome is faceted.

14. The device of claim 9, wherein said first housing part includes a base, a tubular part extending upward from said base, a contact button arranged on said base inside of said tubular part, said internal thread being formed on an inner surface of said tubular part, said second housing part includes a first tubular part and a second, smaller diameter tubular part extending from said first tubular part, said external thread being formed on said second tubular part, said space being defined between a bottom-facing surface of said second housing part at an edge of said first tubular part and a top-facing surface of said tubular part of said first housing part.

15. The device of claim 9, further comprising a plurality of batteries arranged in said chamber and a non-conductive sleeve arranged around said batteries to electrically isolate said batteries from said cylinder.

16. The device of claim 9, wherein said means for preventing water from entering enables said first and second housing parts to be rotatable with respect to one another.

17. A miniature light-emitting diode (LED) device, comprising:

a cylinder including a first housing part having an internal thread and a second housing part having an external thread and rotatably coupled to said first housing part via engagement of said threads, said cylinder defining a chamber for receiving at least one battery;

an LED light assembly arranged in connection with said cylinder; and a faceted dome connected to said cylinder in a position covering said LED light assembly, at least a portion of each of said first and second housing parts being made of conductive material to enable formation of an electrical circuit including said at least one battery when present in said chamber, said LED light assembly and said conductive portions of said first and second housing parts, rotation of said first and second housing parts relative to one another causing formation or interruption of the electrical circuit and thus controlling illumination provided by said LED light assembly, wherein a space is defined between said first and second housing parts alongside said threads, and said device further comprises an elastic ring arranged outward of said first and second housing parts, and surrounding a portion of an outer surface of each of said first and second housing parts to cover said space and thereby prevent water from entering into said space and then between said threads.

18. The device of claim 17, wherein said elastic ring is arranged in contact with part of both said first and second housing parts.

19. The device of claim 17, wherein said elastic ring is dimensioned to provide a friction fit against outer surfaces of said first and second housing parts.

20. The device of claim 17, wherein said elastic ring is arranged to prevent inadvertent movement of said first and second housing parts relative to one another to thereby prevent inadvertent changing of the on or off status of the device.

21. The device of claim 17, wherein said means for preventing water from entering enabling enables said first and second housing parts to be rotatable with respect to one another.

* * * * *